United States Patent [19]

Remmler, deceased et al.

[11] Patent Number: 4,509,754

[45] Date of Patent: Apr. 9, 1985

[54] ELECTRIC GAME APPARATUS WITH ROTATING MARKER

[76] Inventors: Andreas Remmler, deceased, late of Neu Isenburg, Fed. Rep. of Germany; by Heinz Remmler, heir; by A. Käthe Remmler, heir, both of An den Grundweisen 65, 6078 Neu Isenburg, Fed. Rep. of Germany

[21] Appl. No.: 583,412

[22] Filed: Feb. 24, 1984

[30] Foreign Application Priority Data

Mar. 11, 1983 [DE] Fed. Rep. of Germany ..... 3308618

[51] Int. Cl.[3] ..... A63F 5/04

[52] U.S. Cl. ..... 273/142 J; 273/142 R

[58] Field of Search ..... 273/142 R, 142 D, 142 F, 273/142 G, 142 JB

[56] References Cited

U.S. PATENT DOCUMENTS 1,474,488 11/1923 Nelson ..... 273/142 F 1,532,160 4/1925 Seymour ..... 273/142 F

FOREIGN PATENT DOCUMENTS 1113880 12/1955 France ..... 273/142 R 165960 1/1955 Netherlands ..... 273/142 D

*Primary Examiner*—Paul E. Shapiro

*Attorney, Agent, or Firm*—Barlow & Barlow, Ltd.

[57] ABSTRACT

A game of chance apparatus includes a rotatable symbol substrate driven relative to a marker by an electric motor. Teeth are mounted coaxially with the symbol substrate and have a tooth repetition equal to that of the symbols. The relative motion between the symbol substrate and the marker can be started or stopped by an electromagnet, the marker and the symbol substrate being lockable into predetermined relative positions by means of the teeth. To reduce operational energy consumption and impact stresses, two annular electromagnets are mounted concentrically to each other and coaxially with the shaft of the symbol substrate. The magnetizable marker is freely displaceable between the poles of the electromagnets. Rings which cannot be magnetized are mounted at a distance from each of the electromagnets between their poles and the associated ends of the marker. Both rings are so shaped and mounted that the marker rests against the ring associated with the energized electromagnet and upon contact with a ring engages the teeth.

14 Claims, 7 Drawing Figures

ZG
90
91
88
86
84
80
72
38
34
36
40
74
96
42
78
82
82
66
64
44
30
26
60
102
68
28
28
24
22
100
58
62
59
56
58
104
48
50
66
70
99
96
54
52
94
92
46
32
20
20

ELECTRIC GAME APPARATUS WITH ROTATING MARKER

The invention concerns an apparatus for playing games, with a symbol substrate and a marker which can carry out a relative displacement by means of an electric motor, with a plurality of teeth coaxial and fixed with respect to the axis of the symbol substrate and of which the spatial frequency equals that of the symbols on the symbol substrate, and with an electromagnet which releases the relative motion between the symbol substrate and the marker and interrupts it after a random generator output, the marker and the symbol substrate being mutually lockable into one of several angular-displacement positions predetermined by the teeth.

As regards a known game apparatus of this kind (German Gebrauchsmuster No. 82 02 983), the electric motor and the electromagnet are energized simultaneously and an indexing shoe provided with a groove is pulled out of a plurality of teeth against spring opposition, thus driving the symbol substrate. The electric motor and the electromagnet are simultaneously shut off, and the indexing shoe is forced by the spring into the teeth. The moment one of the teeth engages the groove of the indexing shoe, the symbol substrate and the electric motor are stopped. For every indexed position of the symbol substrate, one of its symbols is located behind a viewing window forming the marker.

A substantial expenditure of energy is required to actuate the electromagnet against the spring force. Furthermore the impacting stoppage of the symbol substrate and the electric motor result in substantial wear-inducing stresses in them and also in the indexing shoe and the teeth.

It is the object of the invention to create a game apparatus of the indicated species for which the operational energy and the impact stresses are reduced in a simple manner.

This problem is solved by the invention in that the poles of two annular electromagnets are mounted approximately in mutually coaxial manner and concentricaly with the shaft of the symbol substrate; in that a marker is designed to be a freely moving magnetizable element and is mounted between the poles of the electromagnets; in that a non-magnetizable ring is mounted in each case between the poles of the electromagnets and the ends of the marker facing the electromagnets, this ring furthermore being located a distance from these electromagnets; in that one of the rings is mounted on the symbol substrate and in that the rings are so shaped and arranged that the marker shall rest only against the actuated electromagnet and upon making contact with this one ring shall engage the teeth.

In this design, only the marker, which is in the form of a relatively lightweight element, is made to engage or disengage the teeth depending on the actuation of either electromagnet without thereby the symbol substrate and the electric motor being stopped while the marker engages the teeth and thereby features a given symbol as being in place. They can freely move after the marker engages the teeth, the marker revolving with the symbol substrate. The switch over of the lightweight marker to engage or disengage it can be carried out with minute energy. Therefore no significant impact takes place at the time the lightweight marker engages the teeth. The wear is correspondingly slight. The game increases in allure for the player because he can visually follow the relative motion of the marker and symbol substrate in the manner of the ball and the number wheel in roulette.

The electromagnets preferably are fixed. Even though they may be rigidly joined to one or each of the rings, their rigid mounting to the frame of the apparatus offers the advantage that the electric motor need not accelerate their mass and that sliprings or the like for their power supply can be eliminated.

The other ring which is not fastened to the symbol substrate can be rotatably supported on a shaft of the symbol substrate and be driven in the direction opposite to this shaft's rotation. In this case when the marker is attracted to this ring by its associated electromagnet, the symbol substrate and the marker will rotate in mutually opposite directions. Therefore the symbol substrate and the marker can revolve at comparatively low angular speeds and accordingly they require only comparatively low energy for acceleration when the electric motor is turned on. On the other hand the read-out of the indexed relative rotational angular position of the symbol substrate and the marker is facilitated and the slowdown time of the symbol substrate and the marker is shortened. Nevertheless their relative speed in operation may be so high that it will be impossible for the player to detect their relative motion.

The marker is preferably circular. This offers the advantage that no matter what the particular angular position with respect to its own central axis perpendicular to its circumference, it can be made to engage the teeth without having to index it with the teeth at cost in time and energy.

Further, the symbol substrate can be a transparent disc with the marker being in the form of a smaller disc mounted behind the symbol substrate approximately perpendicularly to the axis of rotation of this symbol substrate. Because of their flat shape and low mass the discs evince only minute moments of inertia and accordingly can be accelerated or stopped with respect to each other at very low cost in energy. Simultaneously the symbol substrate covers an annular space receiving the marker while nevertheless making possible the observation of all the symbols and the marker.

If the marker assumes the form of a disc, advantageously the electromagnet poles are facing the symbol substrate disc and the rings are designed as annular plates, the surfaces thereof facing the marker subtending a shallow angle of which the apex faces the marker. The electromagnets may be apart by a slight radial distance, so that for a predetermined diameter of the circumferential path of the marker it will be possible to maintain the outer diameter of the radially outer electromagnet small and hence the radial dimensions of the components supporting and/or surrounding said electromagnet in relation to said diameter of motion may also be small. This makes possible compactness with correspondingly low moments of inertia for the revolving parts, in particular for the symbol substrate.

The surface of the one ring which faces the disc-shaped marker may include elevations coinciding with the radial center line of each particular tooth of the plurality of teeth, this coincidence being symmetrical. As a result the marker drawn against the teeth does not assume a stable position in front of a tooth tip, instead tending to slip to one side where it will be drawn between two teeth.

Alternatively the marker also may be provided with a conical reverse side that faces the electromagnet poles and the rings are annular discs, with the disc surfaces that face the marker subtending a shallow angle of which the apex faces away from the marker. As a result there is contact only along a line between the marker and its radially inner disc, so that the marker can tip about the line of contact and would be drawn between two teeth if during this procedure it were pulled against the tip of a tooth.

It is also possible to achieve or enhance the instability of the marker at one of the rings on the radial center line by providing magnetizable strips in the surface away from the marker of one of the rings which radially coincide with the radial center line of a particular tooth.

The rings can be provided with groove-shaped running surfaces for the circular marker and at least one of the running surfaces may comprise a plurality of teeth. In this case an additional support member for the teeth is eliminated and therefore the moment of inertia to be overcome by the start-up electric motor is correspondingly less. In this case too there will be at best only a line of contact between the marker and the teeth.

The marker will be especially low in inertia if it is in the shape of a spherical shell.

It is furthermore advantageous to apply the drive voltage to the coil of one of the electromagnets by a first switching means with time delayed break and the drive voltage to the coil of the other electromagnetic by a second switch means with time delay break, and to actuate the switch means alternatlingly by a reversing switch. As a result the electromagnets will be simultaneously energized for a brief time following reversal, until the time delay lapses, and therefore the reversal takes place without complete removal of the magnetic field which might produce uncontrolled motion of the marker due to its centrifugal force and weight and therefore also possibly an impacting stress.

In addition, each of the electromagnet coils may include a low-resistance and a high-resistance section, with the high-resistance sections being shuntable each by a switch means with time delay, these switch means being alternatingly actuated by the reversing switch. Therefore the attraction current of the particular turned-on electromagnet is switched over to a low latching current after the time delay has lapsed, and power is saved.

Moreover a light trip means may be associated with the revolving path of the marker. This makes possible sensing the relative position between symbol substrate and marker with a minimum of friction and wear. The position may be electrically analyzed, and produce an output in the form of a symbol or other prize display.

The invention and further developments of it are discussed below in closer detail in relation to the drawings showing preferred embodiments.

The figures represent parts of a coin-actuated game apparatus with potential prizes.

Figure 1:
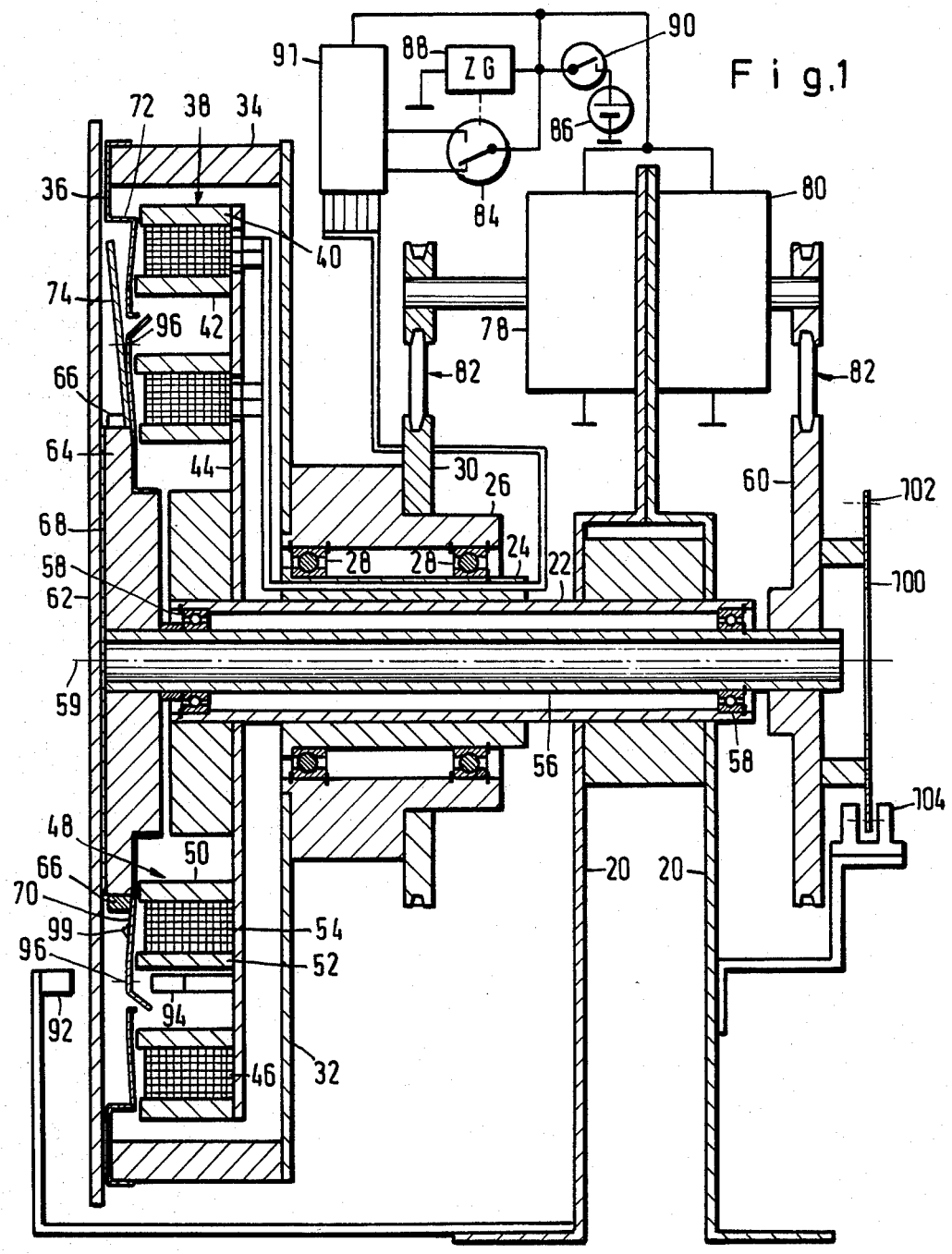
FIG. 1 is a cross-section of part of a first embodiment of a game apparatus of the invention.
Figure 2:
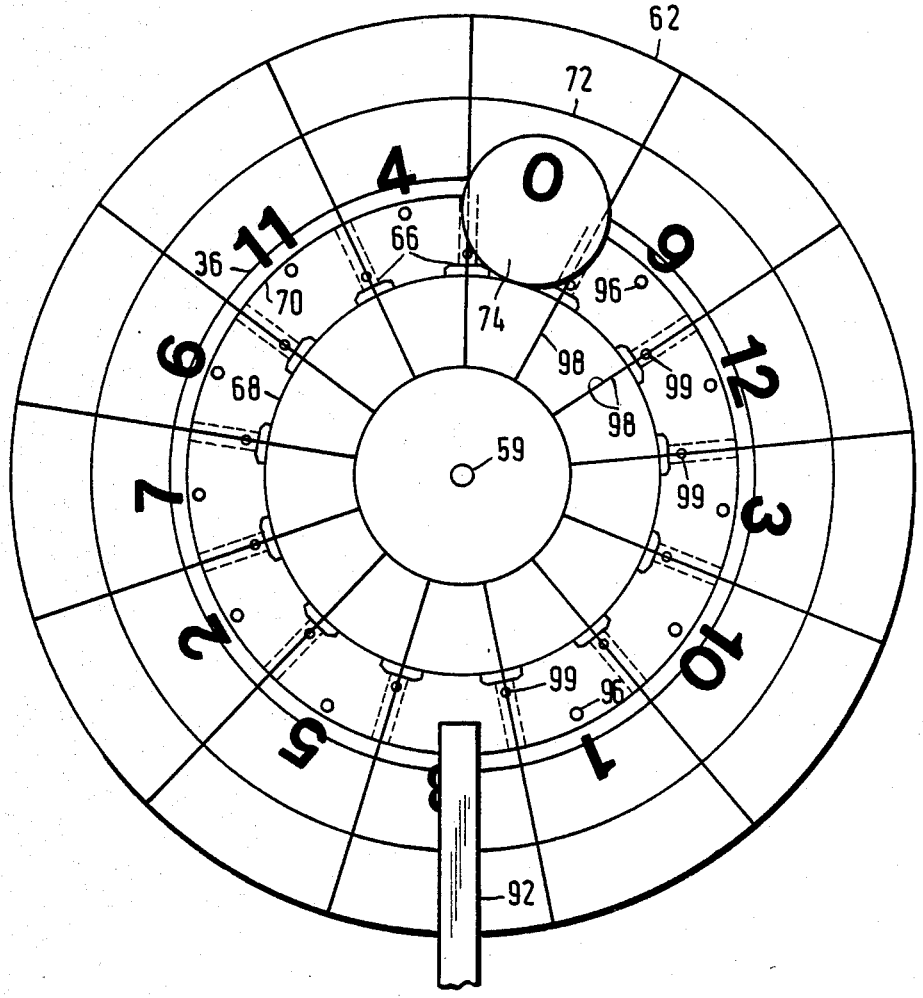
FIG. 2 is a front view of the part of FIG. 1.

As shown in FIGS. 1 and 2 the game apparatus includes a frame 20 which acts as a fixed support for a pipe 22. A sleeve 24 is coaxially mounted on the pipe 22, a further sleeve 26 being rotatably supported by ball bearings 28 on and coaxially with the sleeve 24. A drive wheel 30 and an annular disc 32 are coaxially fixed on the sleeve 26. A cylinder 34 is fastened on the annular disc 32 coaxially with the pipe 22 whereby the annular disc 32 and the cylinder 34 form a container. A ring 36 formed of a non-magnetizable material is fastened coaxially with the pipe 22 on that rim of the cylinder 34 which is remote from the annular disc 32. The ring 36 extends radially inward spaced from and across the poles of an annular electromagnet 38 which is coaxial with the pipe 22. The electromagnet 38 consists of two coaxial cylinders 40 and 42 made of magnetizable material, a toroidal coil 46 between the cylinders 40 and 42, and a magnetizable annular plate 44 supporting the cylinders 40 and 42, coaxially fastened on the pipe 22.

Another electromagnet 48, consisting of two coaxial magnetizable cylinders 50 and 52, a toroidal coil 54 and the annular plate 44 is coaxial with the electromagnet 38, from which it is spaced radially inward, the cylinders 50 and 52 being fastened to the annular plate 44.

The pipe 22 also supports in rotatable manner a hollow shaft 56 revolving in ball bearings 58 about an axis 59. A second drive wheel 60 and a symbol substrate 62 in the form of a transparent glass disc are mounted on the shaft 56, the symbol substrate 62 being mounted at one end and the drive wheel 60 at the other end of the shaft 56 that projects from the pipe 22, the symbol substrate 62 spaced from and covering the axial opening of the container 32, 34. A circular part 64 with a plurality of teeth 66 on its circumference is also mounted on the end of the shaft 56 that projects from the pipe 22 and is connected by a spacer disc 68 with the symbol substrate 62. A further ring 70 in the form of a non-magnetizable annular plate 70 is mounted on the part 64 and extends radially outward spaced from the poles of the electromagnet 48.

The rings 36 and 70 are angled in mutually opposite directions and therefore they form an annular ridge facing the symbol substrate 62 and between the two electromagnets 38 and 48.

A marker in the form of a circular flat disc 74 made of a magnetizable material is mounted to overly the rings 36 and 70 on one hand and closely adjacent the underside of the symbol substrate 62 on the other. The diameter of the marker 74 is less than the radial spacing between the teeth 66 and the shoulder 72 of ring 36.

Two electric motors 78 and 80 are mounted on the frame 20; and drive wheels 30 and 60 respectively by a transmission means 82, in this case a V-belt drive, in mutually opposite directions.

The electromagnets 38 and 48 can be alternatingly connected by a reversing switch 84 to a source of voltage 86. The reversing switch 84 is controlled by a random generator 88 once it has been switched on by the power switch 90. Switch 90 simultaneously energizes the electric motors 78 and 80.

A delay circuit 91 is located between the reversing switch 84 and the toroidal coils 46, 54 to provide overlap of the drive currents in the coils of the electromagnets 34, 48 following reversal of the switch 84 and thereafter to reduce the particular energizing current to a lower latching current. The overlap of the drive currents makes it possible to keep the marker 74 always in a magnetic field even when switching over, so it will not be moving in uncontrolled manner. Lowering the current from the energizing to the latch mode saves energy.

A light-tripping means fixed to the frame including a light source 92 and a light sensor 94 scans holes 96 circumferentially arranged on the ring 70 to detect the relative position between the marker 74 and the symbols displayed at equal angular spacings on the front side of the symbol substrate 62, in this instance the arabic numbers 0 through 12. One hole 96 is associated with each symbol 0 through 12 (see FIGS. 1 and 2). Each symbol is displayed within a sector of circle bounded by radial lines 98 on the disc 62, the number of the symbols 0 through 12 and of the teeth 66 as well as their spatial frequency being equal.

The ring 70 is provided on its front side with wart-shaped elevations 99 which also can be designed to be radial ribs. The elevations 99 have the same frequency as the teeth 66 and accordingly there is one elevation for each tooth 66. The elevations 99 prevent the marking 66 from assuming a stable position precisely above one of the teeth 66 on the boundary coinciding with one of the lines 98 between two sectors of circle. Rather, if the marker 74 were pulled by the electromagnet 48 precisely against the center of the end surface or top of a tooth 66, it would tip to the side on account of the elevation 99 and be pulled into the area between two teeth 66, thereby being unambiguously associated with one of the sectors of circle.

A perforated disc 100 is mounted on the wheel 60, with its holes 102 arranged at the same angular frequency as the holes 96, said holes 102 being scanned by another light trip means 104 fixed to the frame.

Figure 2A:
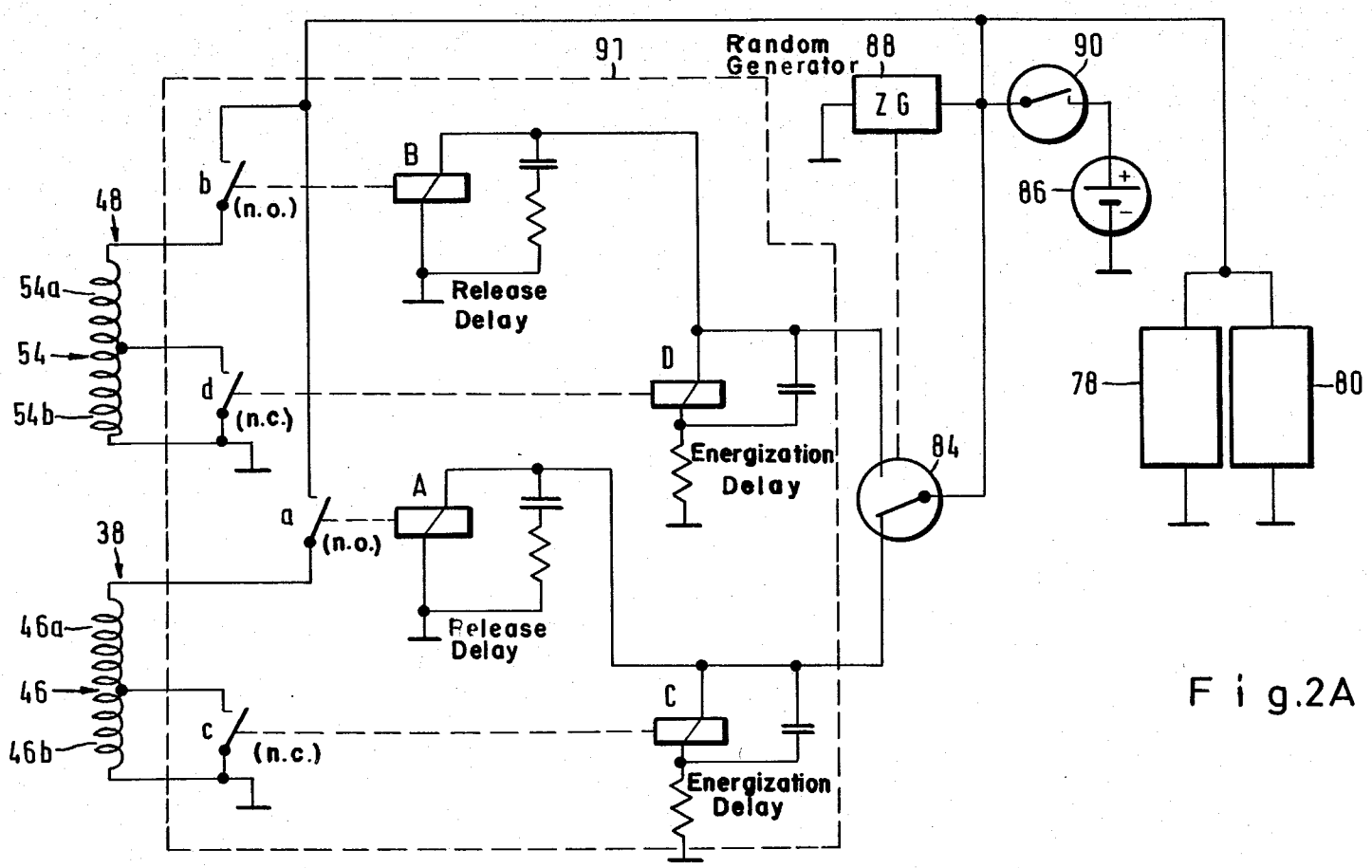
FIG. 2A is a circuit diagram of a control for the game apparatus of FIGS. 1 and 2.

FIG. 2A shows in more detail the control circuit for the electromagnets 38, 48. This figure includes two switch means A, B provided solely with break-delay; in this instance they are relays with release delay, and two switch means C, D with make-and-break delays. The release delay of the relays C, D is equal to or larger than that of the relays A, B. An operational or normaly open contact a of relay A is located between the coil 46 and the voltage source 86 and an operational contact b of relay B is located between the coil 54 and the voltage source 86. The coils 46 and 54 each consist of a low-resistance part 46*a* and 54*a* respectively and of a high-resistance part 46*a* and 54*b* respectively. The rest position of a normally closed contact c of the relay C shunts the high-resistance part 46*b*, and the rest position of a normally closed contact d of the relay D shunts the high-resistance part 54*b*. The relays A, C on one hand, the relays B, D on the other hand, respectively are connected to opposite poles of the single pole double throw reversing switch 84. One RC series circuit each is in parallel with the operating coil of relays A, B and one ohmic resistor each is in series, and one capacitor each is in parallel with the operating coil of relays C, D.

In the rest position the switches 84, 90 and the relays A through D will be in the positions shown. The moment the power switch 90 is closed for example by the feeding of a coin, the motors 78, 80 and the random generator are operative. Simultaneously the relay A energizes, whereby the contact a is closed and the electromagnet 38 is turned on. Due to the energization delay of relay C, the contact c still remains closed, whereby only the low-resistance coil part 46*a* is energized by a current yielding relative high magnetic force and the marker 74 is pulled by the electromagnet 38 toward the ring 36. After the energizing delay of the relay C has lapsed, this relay too energizes and opens the contact c, whereby presently the current also passes through the high-resistance coil part 46*b* but reduced to the level of the much lower latching current. In spite of the presently higher number of total coil turns, the ampere-turns are lower. Because the marker 74 meantime has neared the electromagnet 38 as close as the gap determined by the ring 36, this marker 74 nevertheless is still being adequately attracted by the electromagnet 38. Simultaneously the symbol substrate 62 and the ring 36 holding the marker 74 are being rotated in mutually opposite directions, whereby the marker 74 and the symbols 0 through 12 revolve in mutually opposite directions too.

Upon termination of the time determined by the random generator 88, this random generator determines the reversal of the reversing switch 84. Upon reversal, the relay B is immediately energized, whereby the contact b is closed and the electromagnet 48 is energized. Due to the energizing delay of the relay D and the release-delay of the relays A and B, the contacts a and d remain closed, while contact c is opened, that is, a low current continues through the entire coil 46 and simultaneously a high current passes only through the coil part 54*a*. The marker 74 still is attracted by the electromagnetic 38. Only after the relay A is deenergized will the electromagnet 38 be turned off. Because the electromagnet 48 already is energized through its low resistance coil part 54*a*, the marker 74 at once is pulled by the larger force of the electromagnet 48 against the ring 70 and between two teeth 66. Immediately, thereupon, the energization-delayed relay D also is energized, the contact d opens and the current of the electromagnet 48 is switched to a lower latching current. The symbol substrate 62 and the marker 74 now are moving jointly but are relatively at rest.

Immediately after the random generator 88 has switched on the electromagnet 48 by means of the reversing switch 84, the light trip means 92, 94, 104, when in a predetermined angular position of the disc 100, triggers the scanning of the holes 96 or 102. A counter, not shown in the drawing, counts the pulses emitted from the two light trip means until a pulse from the light trip means 92, 94 is missing due to the marking 74 covering a hole 96. The pulse count at that time from the light trip means 104 then corresponds to a sequential number, not shown herein, of the sectors of circle of the symbol substrate 62 and associated with the symbol within that sector. If payment of money is associated with this symbol, the game apparatus automatically pays out the particular amount of money. Only thereafter is the switch 90 reset automatically so that a new game may start.

In lieu of an apparatus such as shown in FIGS. 1 and 2, the game apparatus may also include several such apparatus energized by a common power switch. In that case different sums of money to be paid to the winners must be associated with different combinations of symbols for all the symbol substrates.

While the symbol substrate 62 and the marker 74 revolve in mutually opposite directions, the player can easily monitor the path of the marker 74 and of the symbols 0 through 12 in merely visual manner just as for roulette (for a corresponding selection of the angular speeds of the symbol substrates 62 and ring 36), without however being able to pre-ascertain the final relative rest position between the symbol substrate 62 and the marker 74. This raises the attractiveness over a mechanical game wherein the symbols sequentially rotate behind a small aperture "window" in a front disc forming the "marking" and wherein the final symbol is determined, (i.e. spotted) only when the symbol substrate stops.

Figure 3:
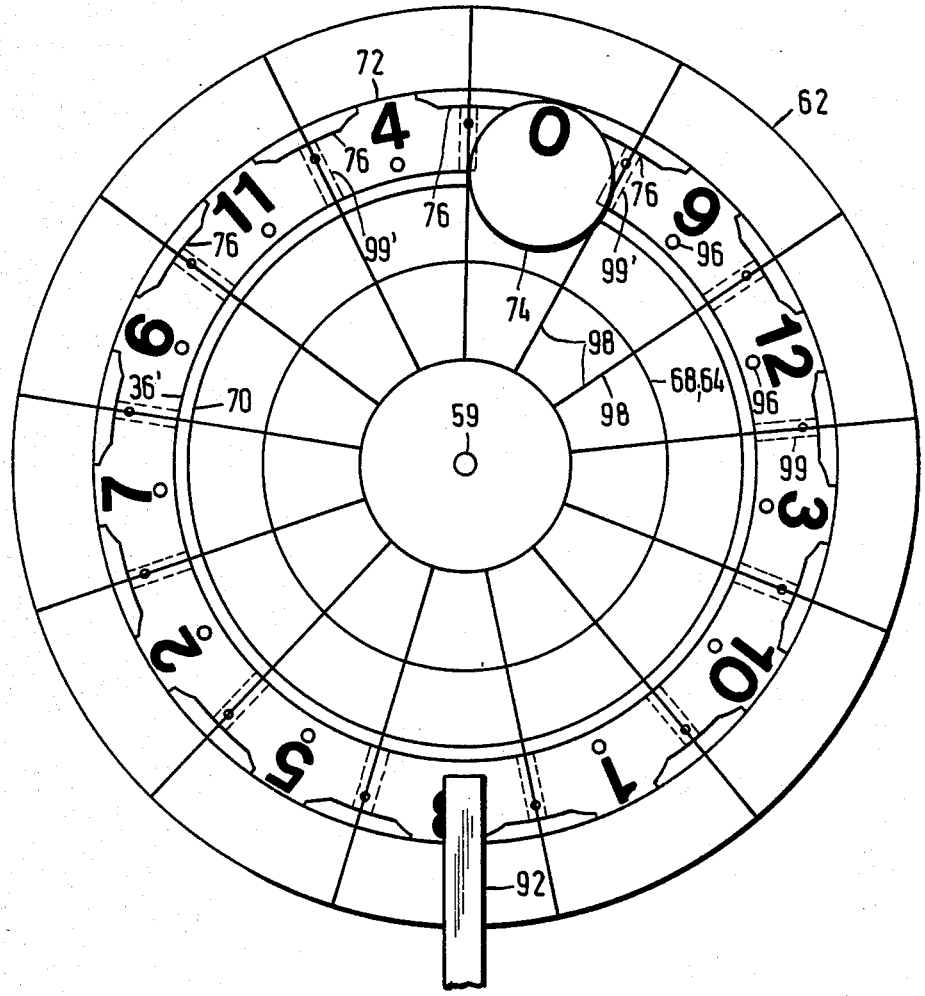
FIG. 3 is a front view of a part of a second embodiment of a game apparatus of the invention.

The embodiment of FIG. 3 differs from that of FIGS. 1 and 2 in that the teeth 66 of the ring 64 are eliminated and instead the ring 36' is provided at its shoulder 72 with radial teeth 76. Accordingly the symbol substrate 62 is rigidly joined to the radially inner ring 70. Furthermore the rest position of the switch 84 is inverted. When the random generator 88 is on, the ring 70 and the marker 74 rotate relatively to the symbol substrate 62 and then, jointly, the marker 74 is pulled between the teeth 76, the ring 70 and the symbol substrate 62. The light trip means 92, 94, 96 is associated with the radially outer ring 70.

In addition to or in lieu of the elevations 99, magnetizable metal strips 99' each coinciding with the radial center line of one of the teeth 76 may be inserted in the reverse side of the ring 36'. The magnetic field of the electromagnet 38 is then shunted in the region of these metal strips, whereby the marker 74 is pulled out of these areas between two adjacent teeth 76.

Figure 4:
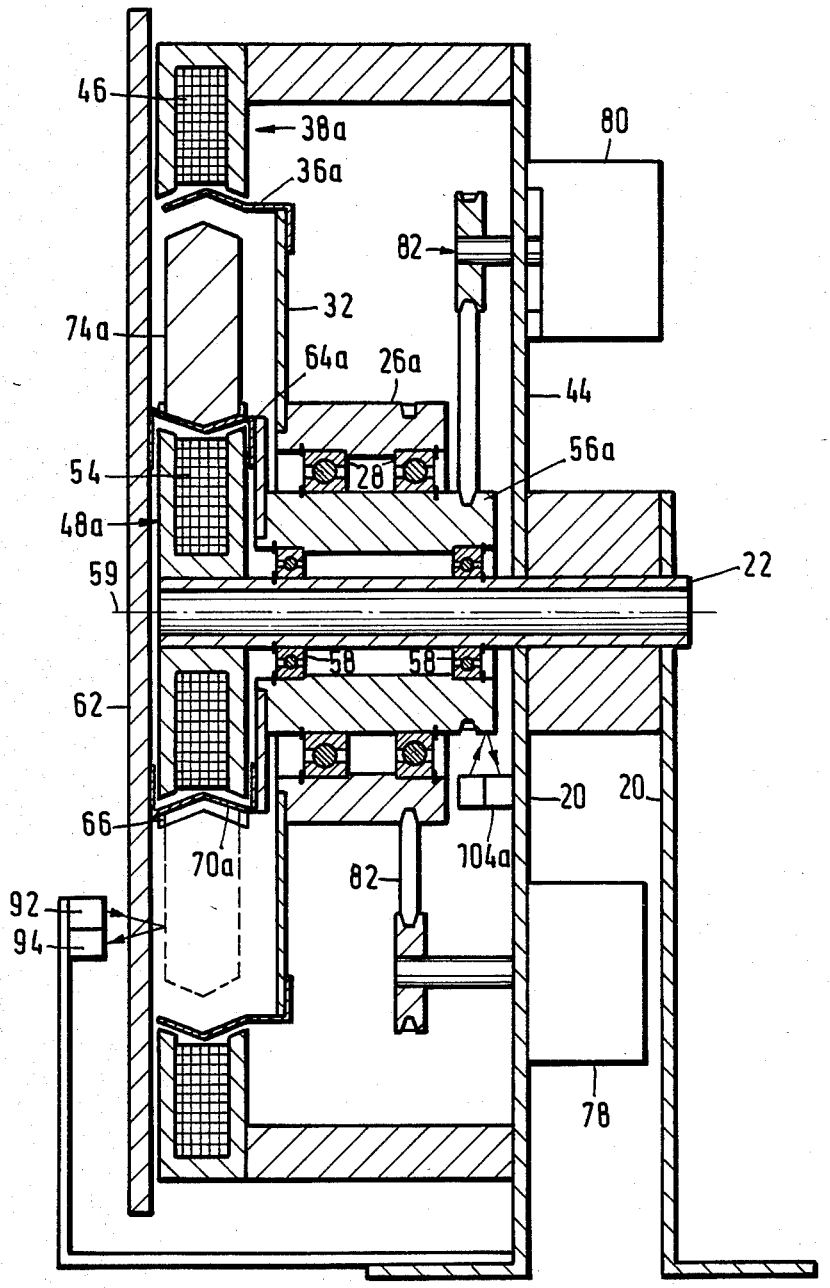
FIG. 4 is a cross-section of a part of a third embodiment of a game apparatus of the invention.

The components of FIG. 4 corresponding to those of FIG. 1 are denoted by the same reference numerals but additionally with the letter "a". Compared to the embodiment of FIGS. 1 and 2, the components 24, 30, 34, 60 and 68 are eliminated. The rings **36*a* and 70*a* are designed to be groove-shaped running surfaces, facing each other in the radial direction, for the disc-shaped marker 74*a*, covering the also mutually facing poles of the electromagnets 38*a* and 48*a*, yet slightly spaced therefrom. The ring 70*a* is directly connected to the symbol substrate 62 and is provided on its running surface with a plurality of teeth 66. The sleeve 26*a* simultaneously forms the drive wheel for the ring 36*a*. Again the shaft 56*a* also forms the drive wheel for the ring 70*a*, being supported outside instead of inside the pipe 22**.

The light trip means 94, 94, is arranged to sense reflected light. The light trip means 92, 94 always generates a pulse when ascertaining the passage of the marker **74*a* which is made specular for that purpose. The light trip means 104*a* scans markers provided on the circumference of the shaft 56*a* corresponding to the holes 102 in FIG. 1. The electrical control, which is omitted from the figure, is the same as for the embodiment of FIG. 1**.

Figure 5:
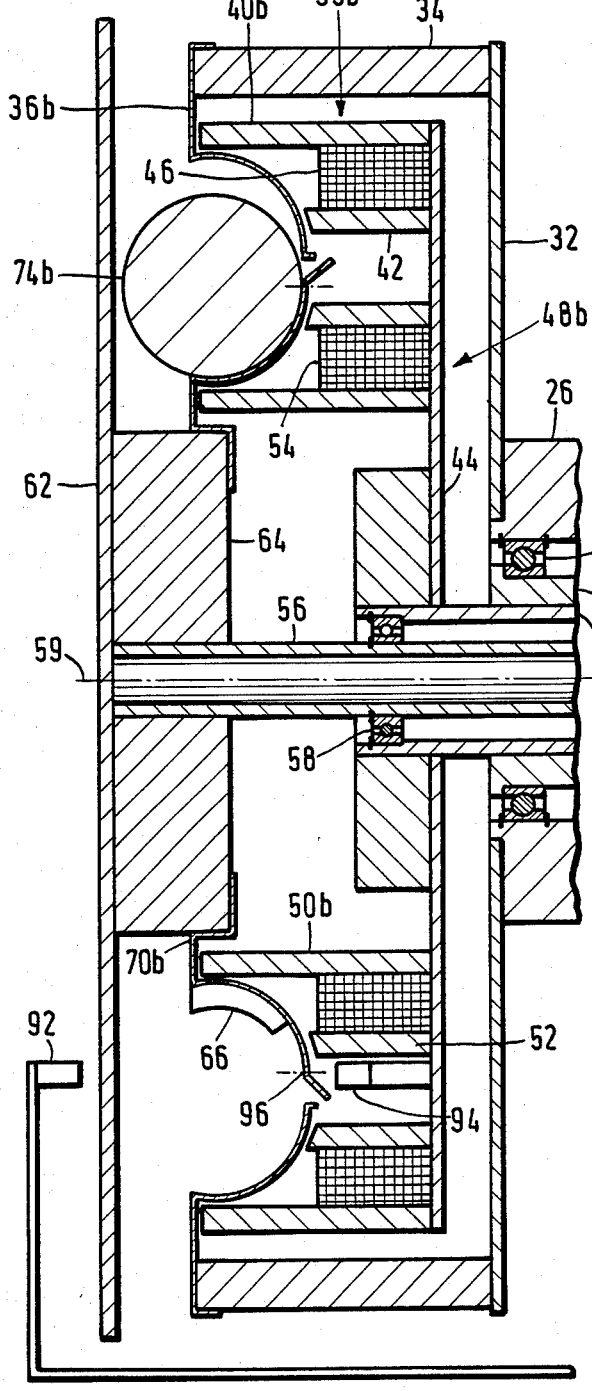
FIG. 5 is a cross-section of a part of a fourth embodiment of a game apparatus of the invention.

The embodiment of FIG. 5 differs essentially from that of FIGS. 1 and 2 only in that the marker **74*b* is a low-inertia, spherical shell and in that the running surfaces of the rings 36*b* and 70*b* form quarter-circle grooves which together form an approximately semicircular groove open toward the symbol substrate 62 and which lie slightly spaced from the poles of the electromagnets 38*b* and 48*b* which face the symbol substrate 62. In this case, too, the teeth 66 are on the running surface of the ring 70*b*. The cylinder 50*b* is somewhat longer in the axial direction than the cylinder 50 to adapt to the shape of the ring 70*b***.

Figure 6:
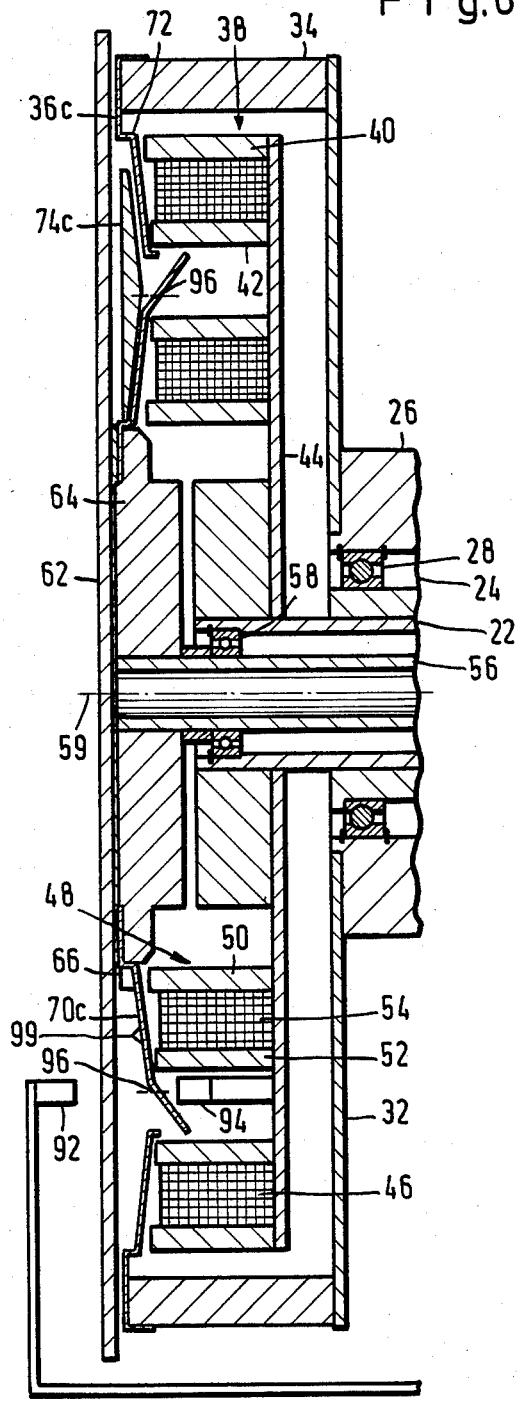
FIG. 6 is a cross-section of a part of a fifth embodiment of a game apparatus of the invention.

The embodiment of FIG. 6 differs from that of FIGS. 1 and 2 only in that the marker 74 is an obtuse-angle cone, and in that the resting surfaces of the rings **36*c* and 70*c* are conically inverted with respect to those of the rings 36 and 70, the conical side of the cone facing the rest surfaces of the rings 36*c* and 70*c*. Even though the cone angles of the marker 74*c* and of the rings 36*c*, 70*c* are approximately equal in the axial section shown, which passes through the center axes of the marker 74*c* and of the rings 36*c*, 70*c*, the difference in the diameters of the marker 74*c* on one hand and of the rings 36*c*, 70*c* on the other prevents a real contact, only lineal contact taking place between the marker 74*c* and in any event the ring 70*c*. Accordingly in this case the elevations 99 might be eliminated because the marker 74*c* might only assume an unstable position on a boundary line between two sectors of circle of the symbol substrate 62 at the center of a tooth 66, in view of the lineal contact between said marker 74*c* with the external concial rest surface of the ring 70*c*, whereby it would tip to the side and would be pulled into a stable position between two teeth 66. However, the elevations 99** enhance the positional instability of the marker.

Other variations of the illustrative embodiments shown can be, for instance, the use of only one electromagnet instead of two, which then would provide the drive in the opposite direction by a corresponding reversing mechanism. In that case only one light trip means suffices, two circumferentially consecutive holes or markings being provided in or at the ring 70 within one sector of circle, whereby a double pulse to provide a reference angular position is formed in said sector of circle to be ascertained in relation to a given angular speed and a timing generator. Starting with the double pulse, the further pulses of the light trip means 92, 94 generated by the holes 96 are then counted as the marker revolves. If the marker prevents the double pulse, this is evidence that it assumes the reference angular position relative to the symbol 62.

In lieu of the random generator 88, the switch 84 also can be actuated manually by some appropriate means because even the most adept player is incapable, when in the presence of sufficiently high relative angular speeds in opposite directions of the symbol substrate 62 and marker 74, to predetermine a desired relative rest position between the symbol substrate 62 and the marker 74.

We claim:

1. A game apparatus having a frame rotatably mounting a symbol substrate and a marker capable of relative motion by means of an electric motor, with a plurality of teeth fixed with respect to the axis of said symbol substrate about which it is coaxially mounted and with a spatial tooth frequency corresponding to that between the symbols on the symbol substrate, further including an electromagnet means allowing the relative motion between the symbol substrate and the marker and interrupting this motion as a function of a random generator output, the marker and the symbol substrate being mutually lockable in one of several rotational angular positions predetermined by the teeth, characterized in that the electromagnet means comprises the poles of two annual electromagnets mounted approximately concentrically to each other and coaxially with the axis of the symbol substrate, one electromagnet being located adjacent the teeth and the other electromagnet being located radially therefrom, the marker being a freely moving magnetizable element positioned adjacent but spaced from the poles of the electromagnets, a pair of non-magnetizable rings each mounted between the poles of the electromagnets and the marker and spaced from the electromagnets, one ring being fastened to the symbol sybstrate, the rings being so shaped that the marker rests only against that ring which is next to the actuated electromagnet and means for selectively energizing said electromagnets whereby when the other electromagnet is energized the marker is held against the ring not attached to the symbol substrate and spaced from the teeth of the symbol substrate, and when the one electromagnet is energized, the marker is held against the ring fastened to the symbol substrate and engages in the space between a pair of teeth.

2. A game apparatus as in claim 1, characterized in that the electromagnets are fixed to the frame.

3. A game apparatus as in claim 1, characterized in that the other ring is rotatably supported about a shaft of the symbol substrate and is driven in the opposite direction of said substrate.

4. A game apparatus as in claim 1, characterized in that the marker is circular.

5. A game apparatus as in claim 4, characterized in that the symbol substrate is a transparent disc behind which the marker is mounted perpendicularly to the axis of rotation of the symbol substrate.

6. A game apparatus as in claim 5, characterized in that the poles of the electromagnets face the symbol substrate, and the rings are annular plates, the areas of the annular plates facing the marker subtending a shallow angle of which the apex points toward the marker.

7. A game apparatus as in claim 6, characterized in that the surface of the one ring facing the disc-shaped marker comprises elevations coinciding symmetrically with the radial center line of any particular tooth of the plurality of teeth.

8. A game apparatus as in claim 5, characterized in that the marker is provided with a conical reverse side, the poles of the electromagnets face the symbol substrate disc and the rings are annular plates, the surfaces of the annular plates facing the marker subtending a shallow angle of which the apex points away from the marker.

9. A game apparatus as in claim 5, characterized in that magnetizable metal strips coinciding radially with the radial center line of any particular tooth are provided on the surfaces of the one ring which faces away from the marker.

10. A game apparatus as in claim 1, characterized in that the rings are provided with groove-shaped running surfaces for the circular marker and that at least the one running surface includes the plurality of teeth.

11. A game apparatus as in claim 10, characterized in that the marker is a spherical shell.

12. A game apparatus as in claim 1, characterized in that the energizing voltage of the coil of one of the electromagnets is applied through a first switch means with break-dealy and the energizing voltage for the coil of the other electromagnet is applied through a second switch means with break-delay, the switch means being alternatingly actuated by a reversing switch.

13. A game apparatus as in claim 12, characterized in that the coils of the electromagnets each include a low-resistance portion and a high-resistance portion, the high-resistance portions shunted by one of said switch means with make-delay, the switch means alternatingly actuated by the reversing switch.

14. A game apparatus as in claim 1 characterized in that at least one light trip means is associated with the circumferential path of the marker.

* * * * *